United States Patent [19]

Van Rooy

[11] 4,337,448

[45] Jun. 29, 1982

[54] ELECTROMAGNETIC DEVICE FOR FOCUSING AND DEFLECTING ELECTRON BEAMS

[75] Inventor: Henricus J. Van Rooy, Eindhoven, Netherlands

[73] Assignee: U.S. Philips Corporation, New York, N.Y.

[21] Appl. No.: 142,320

[22] Filed: Apr. 21, 1980

[30] Foreign Application Priority Data

May 14, 1979 [NL] Netherlands ..... 7903757

[51] Int. Cl.[3] ..... H01F 7/00

[52] U.S. Cl. ..... 335/210; 315/31 TV; 335/214

[58] Field of Search ..... 335/210, 211, 212, 213, 335/214; 361/270; 315/31 TV

[56] References Cited

U.S. PATENT DOCUMENTS 3,974,421 8/1976 Holman ..... 335/214

*Primary Examiner*—Harold Broome

*Attorney, Agent, or Firm*—Thomas A. Briody; William J. Streeter; Laurence A. Wright

[57] ABSTRACT

An electromagnetic device for magnetically focusing and deflecting an electron beam in a television camera tube comprising a vertical deflection coil, a horizontal deflection coil, a ferromagnetic coil and focusing coil. Electrostatic screens are respectively provided on the inner side of the vertical deflection coil and the outer side of the horizontal deflection coil. In order to prevent or substantially reduce interference signals in the focusing coil from the vertical and horizontal deflection coils, which interference is visible in a signal from a camera tube, the focusing coil comprises multifilar windings having the same winding direction and sense. The windings are connected in series such that the magnetic fields produced by each winding are of the same polarity.

4 Claims, 6 Drawing Figures

ELECTROMAGNETIC DEVICE FOR FOCUSING AND DEFLECTING ELECTRON BEAMS

The invention relates to an electromagnetic device for magnetically focusing and deflecting an electron beam in a television camera tube, said device comprising first and second deflection coils for producing magnetic fields or deflecting the electron beam in respective first and second orthogonal directions, as well as a helically wound focusing coil for focusing the electron beam.

BACKGROUND OF THE INVENTION

Electromagnetic devices having a system of deflection coils and a focusing coil for magnetically focused camera tubes are known. Since the video amplifiers in colour television cameras become more improved (greater signal-to-noise ratio), the resulting greater amplification can be used to pick up scenes at lower light levels, and it has been found that in magnetically focused camera tubes much hindrance is experienced from certain interference oscillations which become visible in the video signal (for example as brightness interferences).

It is the object of the present invention to eliminate or at least substantially reduce the interference oscillations in question and the invention is the result of the recognition by the inventor as to the cause of these interference oscillations. It has been found that the cause of the interference oscillations is inter alia residing in the possible excitation of the focusing coil by the line or frame flyback pulses. The excitation of the focusing coil manifests itself during the active picture duration since the interference signal reaches the target of the camera tube by capacitive and/or inductive cross-talk and becomes visible in the video signal.

Due to the very large self-inductance of the focusing coil resulting from its large number of turns (a few thousand), it has not proved possible in practice to sufficiently restrict the interference signals in the focusing coil by means of one or more damping members (damping member is to be understood to mean herein in particular a capacitor, resistor or series arrangement of a resistor and a capacitor connected parallel to the coil or to a part of the coil), while the provision of a static screening around the focusing coil also proved to be of insufficient help.

SUMMARY OF THE INVENTION

The invention, however, presents a solution which is satisfactory in practice. The electromagnetic device of the kind described in the opening paragraph is for that purpose characterized according to the invention in that the focusing coil comprises multifilar windings each winding being wound from an insulated conductor in the same winding sense and direction, the winding being located in substantially contiguous relationship throughout their length, each of the windings having a connection at each of its ends, the windings being connected in series in such manner that when energized each winding produces a magnetic field which fields have the same polarity.

According to the invention, by winding the focusing coil so as to be "multiwire" and connecting the individual windings in series, it has been found that the interference pulses induced in the focusing coil are reduced to such a low level that the video signal is hardly influenced. All this is based on the fact that where the known focusing coils are wound substantially orthocyclically with a single wire, the focusing coil in the device according to the invention is as it were "scramble wound", so that, if one of the wires at a given point conveys a positive interference pulse, the possibility exists that another wire in the same point conveys a negative interference pulse.

A preferred embodiment of the electromagnetic device in accordance with the invention is characterized in that the focusing coil comprises first and second windings each having first and second ends with the respective first and second ends adjacent each other, the second end of the first winding being connected to the first end of the second winding, the first end of the first winding and the second end of the second winding being adapted for connection to an energizing source.

The invention also relates to the combination of a television camera tube and an electromagnetic device having a specially wound focusing coil as described before.

BRIEF DESCRIPTION OF THE DRAWINGS

By way of example the invention will be described in greater detail hereinafter with reference to the accompanying drawings wherein.

DETAILED DESCRIPTION OF THE PREFERRED EMBODIMENTS

Figure 1:
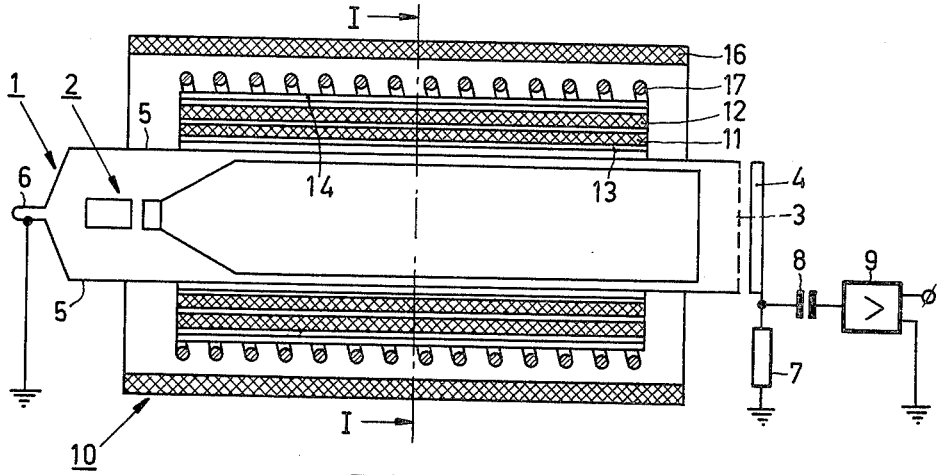
FIG. 1 is a diagrammatic representation of a television camera tube having an electromagnetic deflection and a focusing device according to the invention.

The arrangement shown in FIG. 1 shows a television camera tube 1, for convenience shown without its envelope, having an electron gun 2 for generating an electron beam in the tube, a gauze electrode 3 and a target 4. The gauze electrode 3 is connected to a lead-through pin 6 of the camera tube via a connection 5 which in practical camera tubes is often constructed as two wires situated diametrically in the tube. Via a signal resistor 7 a signal is conveyed from the target 4 to a video amplifier 9 via a capacitor 8. Surrounding the camera tube is an electromagnetic device 10 which comprises a coil 11 for the vertical deflection of the tubes electron beam, a coil 12 for the horizontal deflection of the beam, electric screenings 13 and 14 as well as a helically wound focusing coil 16 for focusing the beam (which coil in the figure is situated around the deflection coils but may also be situated within these coils) and a ferromagnetic coil 17 which inter alia serves to intensify the deflection fields.

Figure 2:
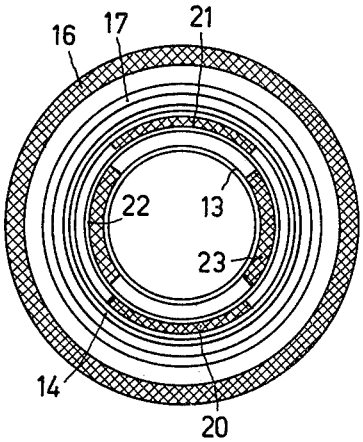
FIG. 2 is a diagrammatic sectional view of the device shown in FIG. 1 taken along the line I—I.

FIG. 2 is a diagrammatic cross-sectional view of the coil assemblies of FIG. 1 where the coil 12 for horizontal deflection is shown constructed from two coil halves 20 and 21, the coil 11 for vertical deflection is likewise shown constructed from two coil halves 22 and 23, with the usual two earthed electric screenings 13 and 14 and the focusing coil 16.

Figure 3:
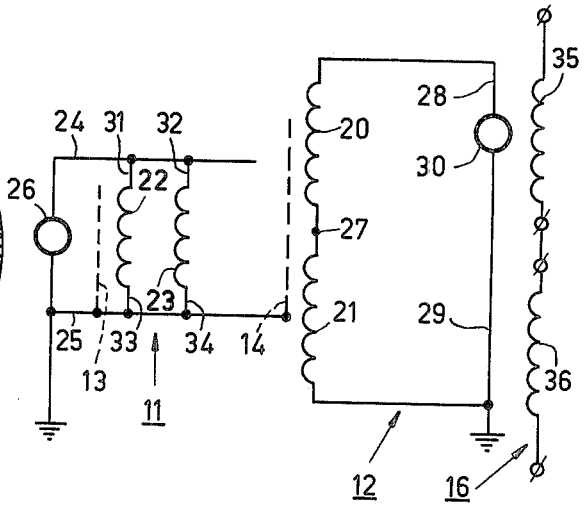
FIG. 3 is a diagrammatic electric equivalent circuit diagram of the deflection coils and focusing coil used in the device shown in FIG. 1.

FIG. 3 shows diagrammatically in an electric equivalent circuit diagram the coil halves 22 and 23 and the earthed screenings 13 and 14. Of the coil halves 22 and 23 (which have a mutually equal winding sense) an inner lead-out wire 31 and an outer lead-out wire 32 are respectively connected to a live wire 24 whilst the other ends 33 and 34 of each of the halves are connected to a wire 25 which in practical cases is earthed. The usual screenings 13 and 14 are connected to the earthed wire 25. A source 26 for energizing the deflection coil 11 is connected to the wires 24 and 25.

The deflection coil 12 in FIG. 3 shows the two coil halves 20 and 21 connected in series through a junction 27 for the horizontal deflection signal derived from source 30 for energizing the deflection coil 12, the coil 12 and source 30 being connected through a live wire 28 and an earthed wire 29. Reference numeral 16 shows the focusing coil which consists of two series-arranged windings 35 and 36.

Figure 4:
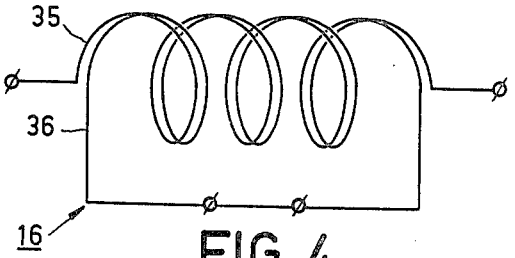
FIG. 4 shows diagrammatically the focusing coil used in the device shown in FIG. 1.

The focusing coil 16 shown diagrammatically in FIG. 4 is a multifilar winding (in this case there are two windings). The windings 35 and 36 being wound simultaneously in the same direction and in the same winding sense from insulated conductors. If in FIG. 4 the left hand ends are the start of the windings and the right hand ends the finish of the windings it will be seen that the series connection of the two windings is such that the finish of winding 35 is connected to the start of winding 36 and the magnetic fields for the windings will be in the same direction. This must also be the case when the focusing coil is made up of more than two windings. As will be explained in relation to FIGS. 5 and 6 it is found that a focusing coil wound in such a manner is considerably less subjected to oscillations induced by line or frame flyback than a usual single wire wound focusing coil so that the interference on the video signal is reduced to a very low level.

Figure 5:
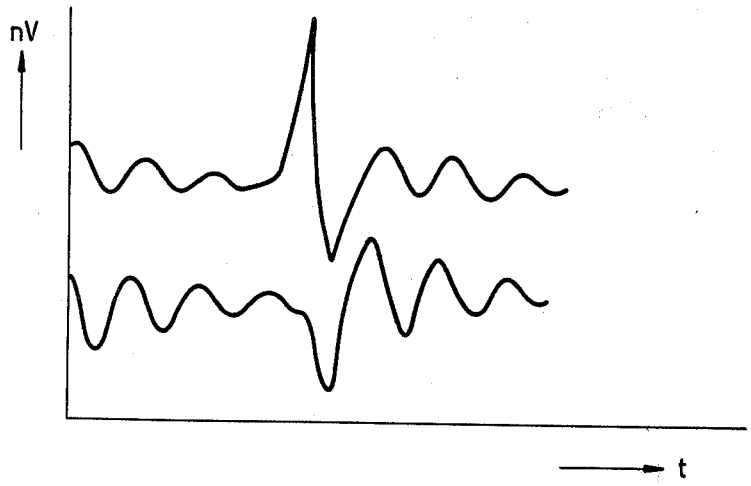
FIGS. 5 and 6 show oscillographs of signals for a camera tube having a single wire wound focusing coil and a multiwire wound focusing coil, respectively.

FIG. 5 relates to a camera tube having a known single wire wound focusing coil. The target of the camera tube was uniformly exposed to light and the voltage between the centre and an end of the focusing coil against time was displayed on an oscilloscope (lower curve) simultaneously with the video signal (upper curve). The oscillographs clearly show how the focusing coil is excited by deflection frequency components and how these components become visible in the video signal.

Figure 6:
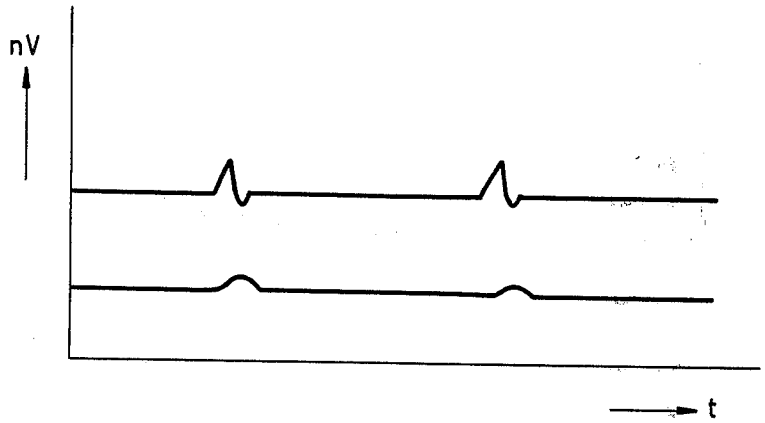

FIG. 6 relates to a camera tube having an electromagnetic device with a multifilar wound focusing coil according to the invention (in the present case a coil having two simultaneous windings, but three, four or more windings may also be wound simultaneously). In the same circumstances as described above the signal between the centre tap and one end of the focusing coil was displayed on an oscilloscope (lower curve) simultaneously with the video signal (upper curve). In this case the interfering pulse deflection components are much smaller and interference of the video signal hardly occurs.

What is claimed is:

1. An electromagnetic device for magnetically focusing and deflecting an electron beam in a television camera tube, said device comprising first and second deflection coils for producing magnetic fields for deflecting the electron beam in respective first and second orthogonal directions, as well as a helically wound focusing coil for focusing the electron beam, characterized in that the focusing coil comprises multifilar windings each winding being wound from an insulated conductor in the same winding sense and direction, the windings being located in substantially contiguous relationship throughout their length, each of the windings having a connection at each of its ends, the windings being connected in series in such manner that when energized each winding produces a magnetic field which fields have the same polarity.

2. An electromagnetic device as claimed in claim 1, characterized in that the focusing coil comprises first and second windings each having first and second ends with the respective first and second ends adjacent each other, the second end of the first winding being connected to the first end of the second winding, the first end of the first winding and the second end of the second winding being adapted for connection to an energizing source.

3. A television camera tube having an electromagnetic device for magnetically focusing and deflecting an electron beam comprising first and second deflection coils for producing magnetic fields for deflecting the electron beam in respective first and second orthogonal directions, a helically wound focusing coil for focusing the electron beam, said focusing coil comprising multifilar windings each winding being wound from an insulated conductor in the same winding sense and direction, the windings being located in substantially contiguous relationship throughout their length, each of the windings having a connection at each of its ends, the windings being connected in series in such a manner that when energized each winding produces a magnetic field that has the same polarity.

4. A television camera tube as claimed in claim 3, wherein the multifilar windings of said focusing coil comprises first and second windings each winding having first and second ends with the respective first and second ends of each winding adjacent each other, the second end of the first winding being connected to the first end of the second winding, the first end of the first winding and the second end of the second winding being adapted for connection to an energizing source.

* * * * *